US005901478A

United States Patent [19]

Sawyer, Jr.

[11] Patent Number: 5,901,478

[45] Date of Patent: May 11, 1999

[54] PORTABLE HAND HELD PNEUMATIC AND WATER POWER EXCAVATOR

[76] Inventor: Thomas K Sawyer, Jr., 308 Oyster La., Virginia Beach, Va. 23456

[21] Appl. No.: 08/864,461

[22] Filed: May 29, 1997

[51] Int. Cl.[6] ..... E02F 3/88

[52] U.S. Cl. ..... 37/323

[58] Field of Search ..... 37/317, 318, 321, 37/322, 323, 195; 299/8, 9, 17; 175/66, 424, 324, 213; 406/88, 96, 162, 153, 157

[56] References Cited

U.S. PATENT DOCUMENTS

| | | | |
|---|---|---|---|
| 2,262,943 | 11/1941 | Kalbaugh | 37/317 X |
| 2,413,561 | 12/1946 | Hehr | 37/323 |
| 2,599,980 | 6/1952 | Dunning | 37/323 |
| 2,960,368 | 11/1960 | Watanabe | 37/323 |
| 4,991,321 | 2/1991 | Artzberger | 37/323 X |
| 5,212,891 | 5/1993 | Schuermann et al. | 37/323 |

*Primary Examiner*—Thomas B. Will
*Assistant Examiner*—Robert Pezzuto

[57] ABSTRACT

The present invention is a high velocity pneumatic and water device for excavating a work area. The device comprises a "T" shaped tubular body that is connected to an external source of high velocity air and water mix. At the top end of the device exists a valve and regulator assembly for individually adjustably controlling the amount of air and water which is delivered to the ports of three separate manifolds contained within the device. Through this adjustable control the device can deliver varying amounts of motive force to a surface and thereby be used to excavate a wide range of materials.

1 Claim, 3 Drawing Sheets

1/3

PORTABLE HAND HELD PNEUMATIC AND WATER POWER EXCAVATOR

BACKGROUND OF THE INVENTION

This invention relates to a portable hand held pneumatic and water power excavator. This device is comprised of a "T" shaped tubular body, having a bottom inlet means. It is controlled by a valve and regulator system which activates air outlet ports connected to manifolds at the bottom and the top end of the device.

The source of energy to operate this device is an external high velocity air compressor with a water source or a "power washer".

This power excavator has the capability to dislodge various materials, break them down into smaller pieces and by a suction method, remove them from the desired work area.

A search of the prior history reveals several patents related to this topic.

U.S. Pat. No. 5,140,759 invented by Thomas Artzberger, titled "PNEUMATIC DEVICE FOR EXCAVATING AND REMOVING MATERIAL", has a drawback in as to re-direct the air flow from pulverizing to suction, you have to manually stop the process you are performing and physically adjust a setting at the bottom end of the device. This takes time and is inconvenient to do. You also cannot simultaneously perform a dislodging and removal operation which aids in speeding up the removal process. Also, this device does not use water as part of the excavating process to help break down the material to be removed. It also lacks an air system on the top end to increase suction and to help keep the ejection chute clear of debris being removed.

U.S. Pat. No. 4,991,321 also invented by Thomas Artzberger and titled "PNEUMATIC DEVICE FOR EXCAVATING AND REMOVING MATERIAL". The main drawback to this invention is that the nozzle for disbursing air is in the center of the suction tube, thus partially blocking matter being sucked up to remove it from the excavation area.

U.S. Pat. No. 4,936,031 invented by Aubrey Briggs and Richard Nathenson is very clumsy and bulky and limited to use because of its size. It is also connected to a trailer with hydraulic cylinders and hoses. This greatly limits its use and adaptability.

BRIEF SUMMARY OF THE INVENTION

This invention has evolved as a result of the disadvantages described in the background of the invention, and the need for a practical hand held device that is easy to use without the need for a lot of expensive supporting equipment.

The main purpose for this invention is for the elimination or at least limited use of the hand held shovel.

A practical use of this invention would be to excavate holes for planting shrubs, or to install fence post, etc. By letting the power of high velocity air and water cut through the soil and debris, and by reversing the air flow to remove the material, the job can be performed with very little labor. There are many commercial uses for this device, from unearthing utility lines to uncovering broken sewer lines.

To fill in the excavated area after the work has been performed, you simply place the vacuuming end on the pile of debris that has been removed and aim the ejection chute toward the excavated area to backfill the excavated area.

DETAILED DESCRIPTION OF THE INVENTION

With particular reference to the drawings the present disclosure includes a portable hand held pneumatic and water power excavator.

Figure 1:
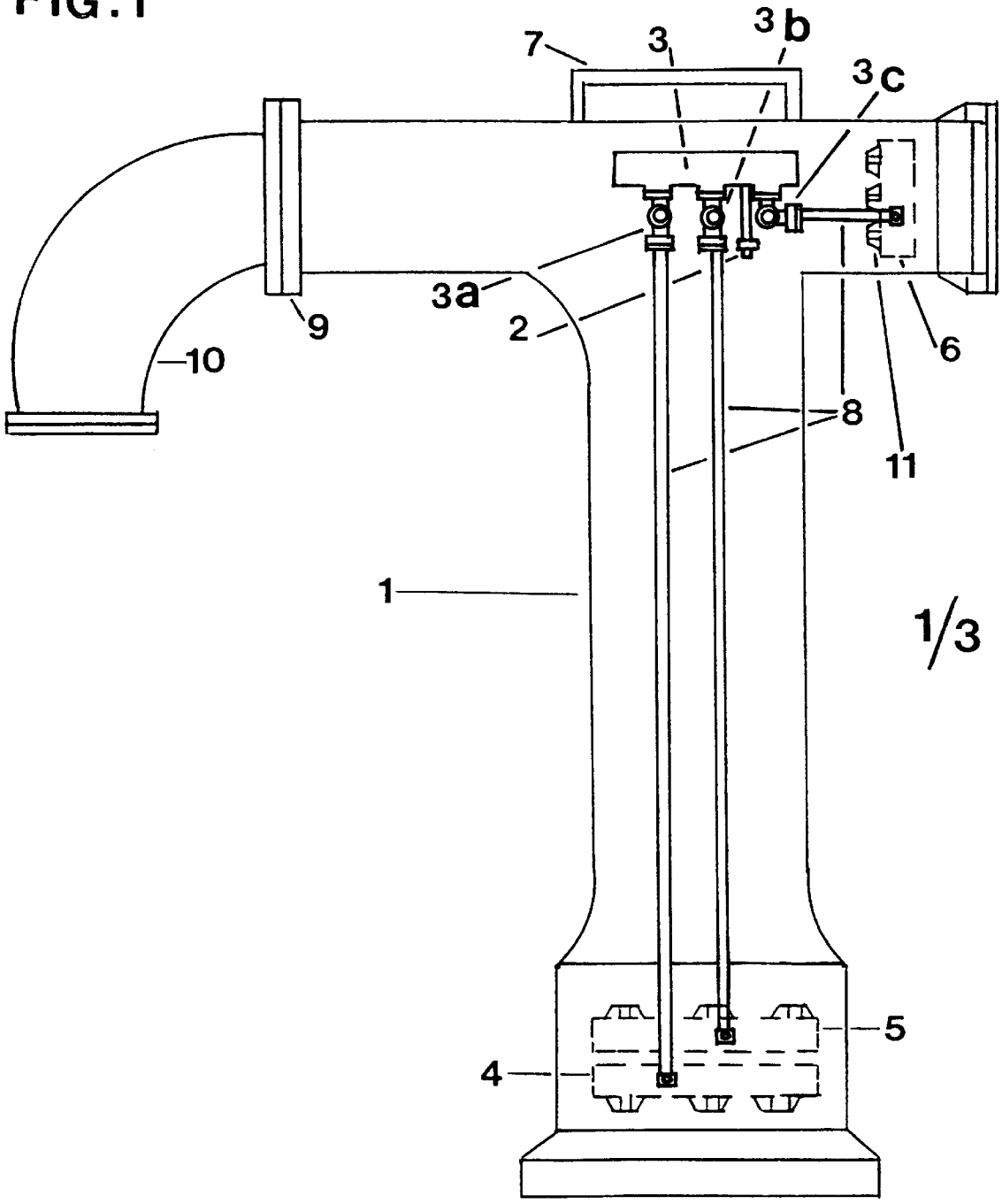
FIG. 1 Is a perspective view showing the "PORTABLE HAND HELD PNEUMATIC AND WATER POWER EXCAVATOR".

FIG. 1 shows an overall view of the device which includes 1, the main T shaped tubular body, 2 the external air and water source connection fitting, 3 the valve and regulator assembly, 3*a* the valve for operating the dislodging manifold and air outlet ports (4), 3*b* the valve for operating the suction manifold and air outlet ports (5), and 3*c* the valve for operating the top manifold and air outlet ports (6) which aids in the suction process and keeps the ejection chute clear of debris being removed through the main tubular body (1). Four (4) is the dislodging manifold with air outlet ports, 5 is the suction or removal manifold with air outlet ports, 7 is the carrying and operating handle, 8 are the high pressure tubes connecting the valve and regulator assembly to the 3 manifolds, 9 is a swivel to change the direction of the debris being ejected through the ejection chute, 10 is the ejection chute.

To operate the portable hand held pneumatic and water power excavator you first connect to an external high velocity source of air and/or water supply. Typically a high velocity power washer would be preferred to connect to the air and water connection fitting, 2. This supplies air and water under high pressure into the valve and regulator assembly 3 which controls the functions of the manifolds on the top and bottom end of the device through the high pressure tubes, 8.

After determining what you are going to excavate you typically would direct the bottom end of the main tubular body 1 toward the area to be excavated, and pushing the valve 3*a* for dislodging, that is, a downward blast of air and water toward the area to be dislodged, then by pushing valve 3*b* which sends a blast of air up the main tubular body 1 to perform a suction in order to lift or remove the dislodged material from the area.

Valve 3*c* which controls manifold 6 can be set to have a continuous controlled supply of air directed at the ejection chute or can be operated with intermittent blasts of air as needed for clearing the chute or for increasing the suction from the bottom end.

Valve 3*a,* dislodging, and 3*b,* suction can be operated simultaneously to expedite the excavation process.

By rotating ejection chute 10 at swivel point 9 the material removed may be directed to various locations to be piled.

Figure 2:
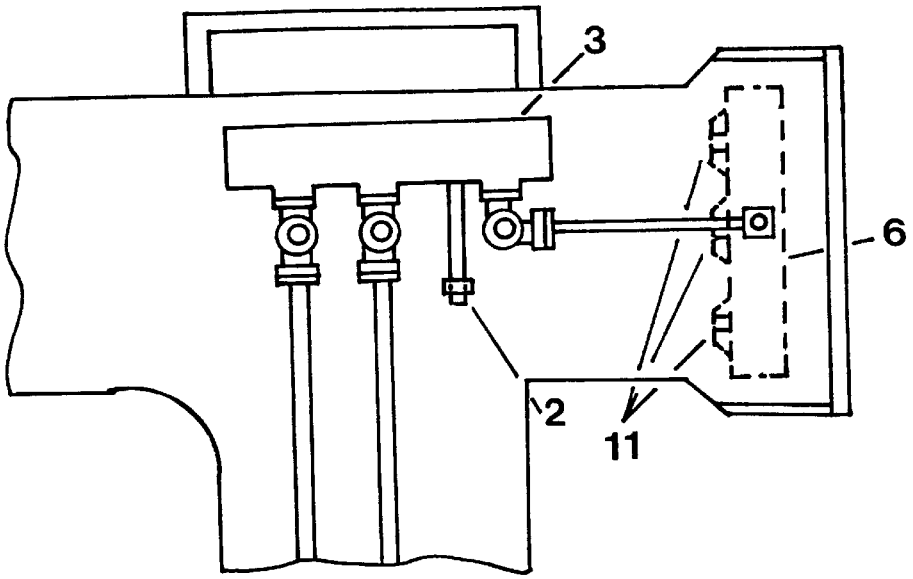
FIG. 2 Is an expanded view of the valve and regulator system, including the top tube, clearing manifold and air outlet ports.

FIG. 2 shows an expanded view of 3 the valve assembly and regulator system and 6 the top manifold with 11 the air outlet ports directed toward the ejection chute. Item 2 is the external air and water connection fitting.

Figure 3:
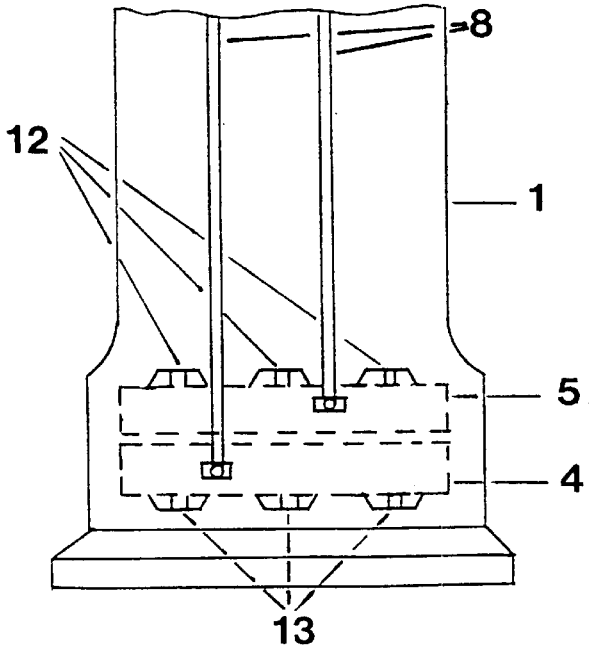
FIG. 3 Is an expanded view of the bottom dislodging and vacuum manifolds with air outlet ports.

FIG. 3 shows 8 the high pressure tubing which connects the valve and regulator assembly to the bottom manifolds 4 and 5. Item 16 is the vacuuming manifold with air outlet ports 12 used for the vacuuming process. These air ports 12 are directed upward in tube 1. Manifold 4 with air outlet ports 13 is directed downward to facilitate the dislodging process.

Figure 4:
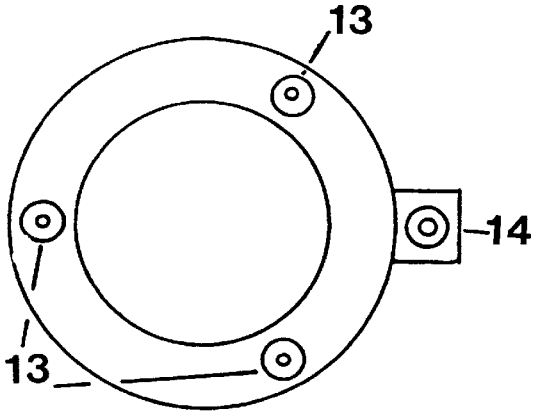
FIG. 4 Is an expanded view of the manifolds and air outlet ports used for the dislodging or vacuuming operations.

FIG. 4 shows an expanded view of a manifold with the 13 air outlet ports, 22 is the connection fitting where the high pressure tubes connect.

Figure 5:
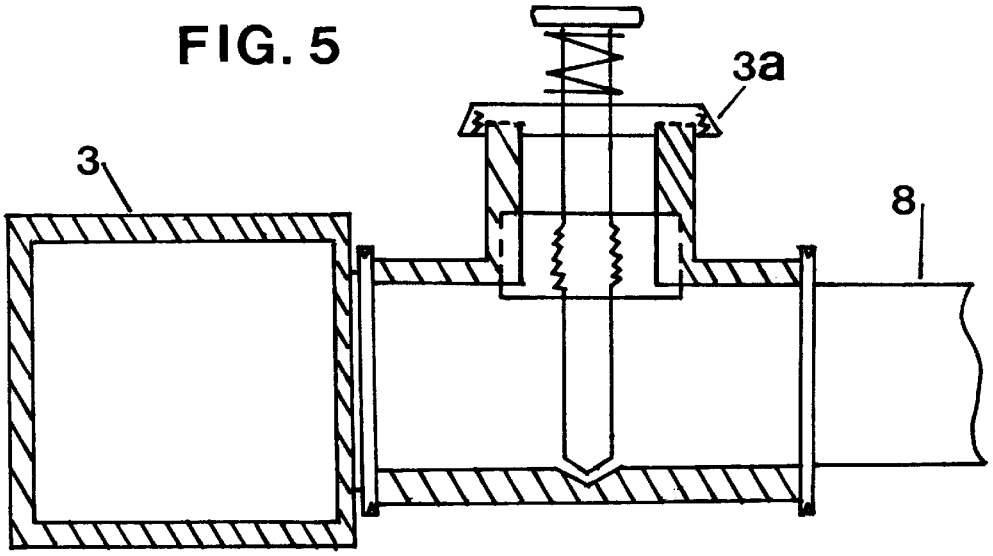
FIG. 5 Is an expanded view and cross section of one of the adjustable valves of the valve and regulator assembly.

FIG. 5 shows an expanded view and cross section of one of the adjustable valves of the valve regulator assembly.

I claim:

1. A generally "T" shaped, hand held, pneumatic and water excavating device, the device comprising a cylindrical first member forming a top portion of said "T" shaped device and having a cylindrical second member fluidly connected to and extending substantially perpendicular from the first member proximal a midpoint of said first member, the second member having an open end;

the first member further having an inlet end and an outlet end, a handle means attached therebetween and an elbow shaped ejection shoot pivotally connected to the outlet end of said first member;

first, second and third manifolds, each manifold having a plurality of ports therein; the first manifold being attached near said inlet end of the first member, said second and third manifolds being attached near said open end of said second member with the ports of the second manifold directed upwardly towards said first member and the ports of the third manifold in a direction opposing that of the ports of the second manifold;

a valve and regulator assembly having first, second and third adjustable valves, said first, second and third adjustable valves respectively being fluidly connected to the first, second and third manifolds whereby an operator can independently operate each of said valves to provide varying fluid pressure through the manifolds and concurrently to excavated material.

* * * * *